United States Patent [19]

Gay, Jr.

[11] 4,378,056

[45] Mar. 29, 1983

[54] METHOD AND APPARATUS FOR BALANCING DISCHARGE FLUID FLOW IN DRILLING MUD TREATMENT UNITS

[76] Inventor: Cleveland J. Gay, Jr., Rte. 2, Box 52, Lafayette, La. 70507

[21] Appl. No.: 304,659

[22] Filed: Sep. 23, 1981

[51] Int. Cl.[3] ..... E21B 21/06

[52] U.S. Cl. ..... 175/66; 175/206

[58] Field of Search ..... 175/66, 206; 210/805, 210/806; 137/578

[56] References Cited

U.S. PATENT DOCUMENTS

| | | | |
|---|---|---|---|
| 39,169 | 7/1863 | Peck et al. | 137/578 |
| 2,923,151 | 2/1960 | Engle et al. | 175/206 |
| 3,289,775 | 12/1966 | Stone | 175/206 |

*Primary Examiner*—Stephen J. Novosad
*Assistant Examiner*—Joseph Falk
*Attorney, Agent, or Firm*—Charles C. Garvey

[57] ABSTRACT

A method of controlling fluid flow in the drilling mud treatment units of an oil/gas well drilling rig such as, for example, the shale shaker, desander, desilter, and mud cleaner portions thereof provides floating the inlet of an intake conduit at the supernatent liquid layer of the drilling rig reserve pit and providing a common distributor head for routing the supernatent liquid to the various solid control units. A pump is connected to the intake conduit and the header at the intake and discharge respectively. The pump transmits the reserve pit supernatent from the reserve pit to the header by pumping. There is provided one or more branch lines affixed to the header each discharging respectively into the drain of a drilling mud treatment unit associated with the drilling rig with the flow of reserve pit supernatent liquid keeping the various drains open. The drains are positioned to discharge back into the reserve pit. The method saves the use of fresh water for the purpose of keeping drains open by the use of the supernatent liquid.

9 Claims, 1 Drawing Figure

METHOD AND APPARATUS FOR BALANCING DISCHARGE FLUID FLOW IN DRILLING MUD TREATMENT UNITS

BACKGROUND OF THE INVENTION

1. Field of the Invention

The present invention relates to the drilling of oil and gas wells and more particularly to the treatment of drilling mud used in the oil/gas well drilling process. Even more particularly, the present invention relates to a method and apparatus for the balancing of fluid flow through the discharge of various solids control and drilling mud treatment units utilized on oil and gas well drilling operations.

2. General Background

In the drilling of oil and gas wells, there is typically used a flow of heavy fluid which is circulated during drilling into the bore hole. This fluid is typically referred to in the drilling art as "drilling mud" and is conveyed from the surface down into the bore hole and returns to the surface with cuttings and the like which are picked up from the bottom of the bore hole as they are cut by the drill bit. When the drilling mud returns to the surface it contains cuttings and other solid material which must be removed from the drilling mud before it can be recirculated back into the bore hole. Various devices are known in the art for the removal of cuttings and solid material from the drilling mud at the surface before the drilling mud is then recirculated back into the bore hole for its use inter alia as a means of retrieving drilling solids, cutting and the like from the bore hole.

Since drilling mud is necessarily quite expensive, this recirculation is typically followed and drilling contractors, oil companies and the like employ various solids treatment devices to treat the drilling mud. One such device is known in the art as a "shale shaker" and it typically removes heavier cutting from the stream of drilling mud. Another type of unit which is known in the art is a "desander", while another is a "desilter", which the two units remove as the names imply sand and silt respectively from the stream of solids.

Another unit which is utilized and typically referred to as a "solids control unit", a hydrocyclone type unit which provides a plurality of hydrocylones that receive drilling mud from the bore hole or from one or more of the other treatment units such as the shale shaker. Liquid is drawn off from the hydrocyclone treatment unit through a common header and each of the hydrocyclones drops drilling mud onto a screen which removes fine solid material from the drilling mud with the drilling mud itself falling back into a mud pit where it can be recirculated back into the bore hole.

Each of the various solids treatment or solids control units have in common and provide respectively a discharge drain which routes the undesirable portion of the stream being treated such as the solid material and the like into a holding pit known as a "reserve pit" where the waste material is held by means of a levee or a dam forming a continuous perimeter which defines the reserve pit holding area. Necessarily, these drains must be kept open and because of the solid content of the discharge stream they can easily become clogged. Thus during times of low flow, water must be used to wash the drains clean so that they will flow freely as is desirable. Typically clean water is used which is costly and wasteful. Clean water is available at the rig site through conventional piping from a water system, but its use on a continuous 24-hour basis during drilling operations can amount to a great deal of expense. For example, a 1-inch stream of water at 30-pounds per square inch can dispense approximately one barrel a minute, which amounts to 720 barrels of water in 24-hours for each of the drains on the various solids treatment units. Once this amount of water has been added to the reserve pit, the added volume must be treated before it can be safely released into the environment. A typical cost of disposing of this water in the reserve pit is approximately 65¢ a barrel.

In normal drilling operations there are at least three drains, each taking, for example, 700 to 720 barrels of fresh water to keep them open at a total of 2,000 to 2,200 barrels of water being added to the reserve pit every 24-hours with an eventual cost of treatment amounting to, for example, approximately $1,500.00 per day.

It is to this problem that the present invention is directed.

Several devices have been patented which are directed generally to the treatment drilling mud and its combination with reserve pit.

See, for example, U.S. Pat. No. 3,766,997 issued to Heilhecker, et al, entitled "Method and Apparatus for Treating a Drilling Fluid". This patent (U.S. Pat. No. 3,766,997) teaches a system for treating drilling fluid which is circulated in a well and contains a fine sized particulate weighted material and drill solids wherein the drilling fluid is passed through a first vibrating screen which removes a portion of the drilled solids and then through a centrifugal separating means to separate the drilling fluid into a low density effluent and into a high density under flow slurry. The effluent is returned to the drilling fluid system and the underflow slurry is further processed through a second vibrating screen. The second vibrating screen is substantially finer than the first vibrating screen and functions to remove additional drill solids. Material passing the second vibrating screen which includes most of the weighted material in the underflow slurry is then returned to the drilling fluids system. The Heilhecker patent discloses generally a solids treatment system to which is the present invention is directed. U.S. Pat. No. 3,766,997 issued to Heilhecker, et al is hereby incorporated by reference.

In U.S. Pat. No. 2,786,651 issued to Mickle there is seen an "Apparatus for Circulating Drilling Fluid in a Rotary Drill".

An "Apparatus and Method for Treating Drilling Mud" is seen in U.S. Pat. No. 3,289,775 issued to Stone.

Tanner, et al discloses in U.S. Pat. No. 3,135,685 a "Device for Collecting Cutting Samples from Well Drilling Operations".

In U.S. Pat. No. 4,234,421 Dover provides a "Land Restoration Following Oil-Well Drilling", which patent discusses inter alia environmental considerations and the use of reserve pits in combination with oil/gas well drilling.

A typical hydrocyclone treatment device and a system for automatically flushing such device is the subject of U.S. Pat. No. 4,090,523 issued to John Kelly, Jr., et al.

3. General Discussion of the Present Invention

The present invention solves these prior art problems and shortcomings by totally eliminating the need for excessive use of water to clean out the solids treatment unit drains, amounting to a savings of as much as $1,500.00 a day or more to the rig operator.

The present invention solves these problems by providing a method and apparatus for controlling fluid flow in the drilling mud treatment units of an oil/gas well drilling rig by placing the inlet of a provided intake conduit within the supernatent liquid layer (i.e., the upper layer liquid above the settled solids) of the rig reserve pit. There is provided a common distribution header adjacent the solids treatment units and connecting to the pump at the discharge portion thereof with the intake conduit connecting to the pump intake. Supernatent liquid is transmitted from the reserve pit through the pump and intake line into the header and thence to one or more branch lines affixed to the header, each of the branch lines dicharging into a respective drain of a selected drilling mud treatment unit such as, for example, the solids control unit, the desilter, the desander, the shale shaker or the like. The flow of this reserve pit supernatent liquid is suitable for keeping the drains open since material from the drain is merely flowing back into the reserve pit anyway.

The present invention solves the prior art problems and shortcomings in a simple, straightforward and inexpensive way. The system of the present invention skims the surface layer or surface water or "supernatent" off the reserve pit on land drilling operations. This use of supernatent water to keep the drains of the solids control units, shale shaker, desander, and the like open saves fresh water costs and subsequent reserve pit treatment costs. The present invention provides a method for selectively adding water as desired to balance the flow of fluid through the drain lines of each of the various solids treatment units as well as can be used to add water to an active mud system so long as it is a water base system.

The present invention removes the need for fresh water which would have to be used to keep the drains on the shale shaker, solids control unit, and the various other units used in the treatment of drilling mud.

It is thus an object of the present invention to provide a method and apparatus for keeping the drains open on various oil/gas well drilling treatment units.

Another object of the present invention is to provide a system for balancing water flow through oil and gas well drilling solids control treatment units which utilized existing waste water from the drilling rig reserve pit.

Another object of the present invention is to save the cost of treating reserve pit water by reducing the overall volume of the reserve pit water.

Another object of the present invention is to provide a method and apparatus for reducing the cost of operating an oil/gas well drilling rig by reducing the amount of fresh water consumed and reducing the amount of waste water to be subsequently treated.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
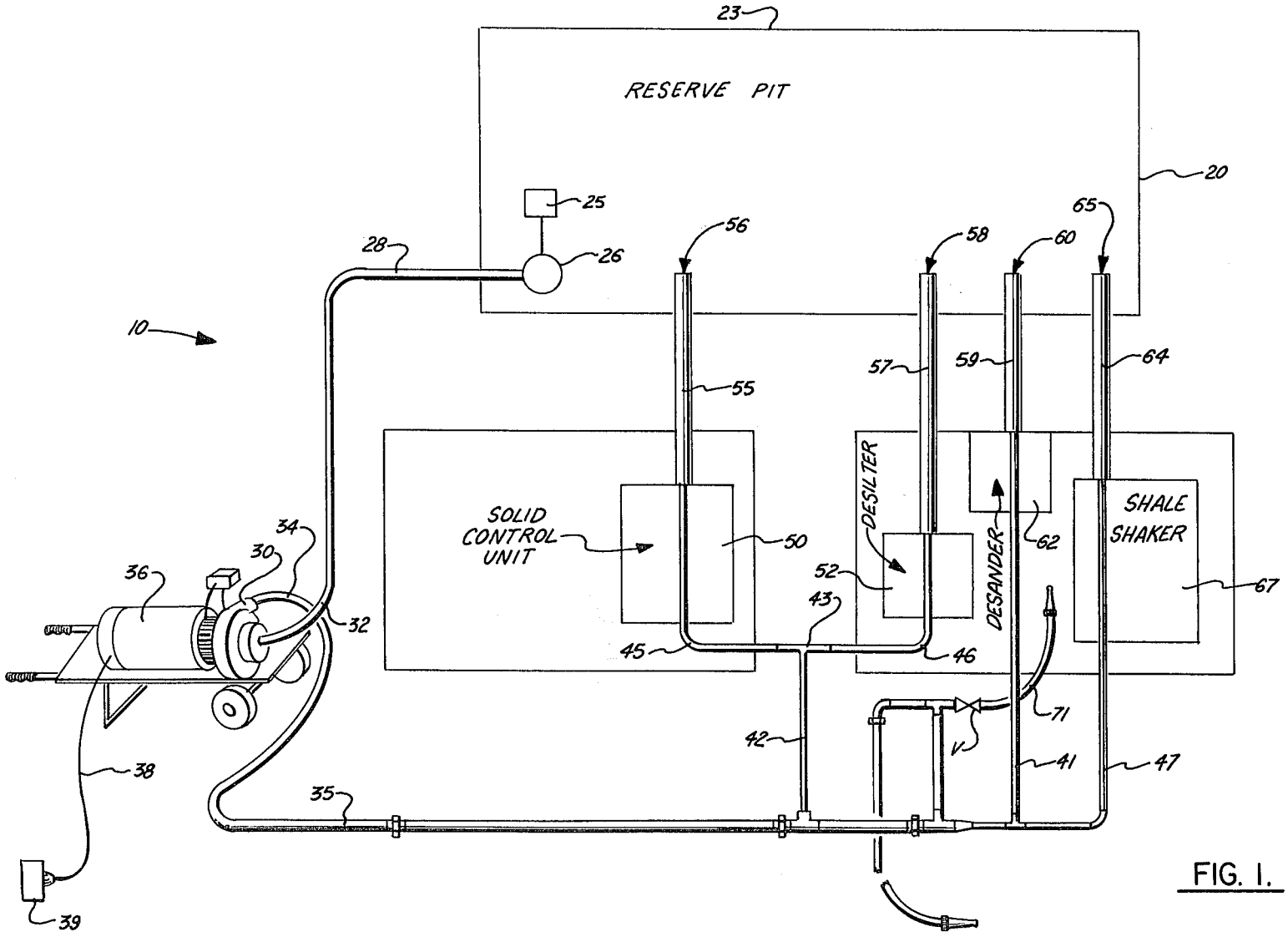
FIG. 1 is a schematic view of the preferred embodiment of the apparatus of the present invention.

FIG. 1 illustrates the preferred embodiment of the apparatus of the present invention designated generally by the numeral 10.

In FIG. 1 there can be seen a reserve pit 20 which typically is merely dug or formed by means of a perimeter 23 which could be a levee built of earth or the like. The inner portion 22 of pit 20 would hold fluid which was discharged from the rig and would typically contain various solid waste materials and the like.

Disposed at the surface of reserve pit 22 is a float 25 supporting intake screen 26 of conduit 28. The float 25 is proximately located to the intake screen. Floatation provided by float 25 assures that the very uppermost layer or supernatent of fluid or water will be taken into conduit 28 from reserve pit 22. This is desirable because the solid matter and other contaminents in reserve pit 22 will normally settle to the bottom portion thereof. The purest fluid (lowest in solids content) would be at the surface and would be desirably taken for use by conduit 28.

Conduit 28 would be connected at the intake 32 portion of pump 30 with a discharge 34 portion of pump 30 connecting to header 35. An electric motor 36, for example, supplied with power through cord 38 connected to outlet 39 would power pump 30 to pump fluids from reserve pit 20, through conduit 28 into intake 32 and discharge the fluid from pump discharge 34 into header 35.

A plurality of branch lines 41–42 and 47 are provided which allow water to be drawn off as desired from header 35. Valving (not shown) could be provided at any place along header 35 or in branch lines 41, 42 or 47. A tee 43 is exemplary of a means of routing fluid from header 35 into branch line 42 and thence to other secondary branch lines 45, 46 which provide fluid to the drains of the solids control unit and desilter. In FIG. 1 the desilter is designated by the numeral 52 while the solids control unit such as, for example, a hydrocyclone-type solids control unit is designated by the numeral 50. Also seen are desander 62 and shale shaker 67. A plurality of drain lines 55, 57, 59 and 64 are seen which discharge respectively into reserve pit 20 at 56, 58, 60 and 65.

Note that the distal end portion of each respective branch line 45, 46, 41 and 47 is placed generally at the intake of each respective drain 55, 57, 59 and 64. This allows fluid which is the uppermost layer or supernatent of the reserve pit to be used to keep the drains 55, 57, 59, 64 open at all times rather than using fresh water for this purpose. Any of the branch lines could be used to transmit recycled water to water base mud if desired. The drawing shows a valve V which valves flow from the header 35 to branch line 71 having a nozzle and base at its end.

Pump 30 could be, for example, a two-inch by three-inch centrifugal pump driven by, for example, a 15-horsepower explosion proof electric motor. Pump 30 could be mounted on a base having wheels, for example, and would provide a three-inch suction hose and a discharge header of, for example, three inches which would tee off as indicated in the drawings to one inch branch lines which could be, for example, flexible hoses.

In normal drilling operations there are at least three drains taking water in order to keep them open at all times, in the drawings, four drains having been illustrated.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limited sense.

What is claimed as invention is:

1. A method of controlling fluid flow in the drilling mud treatment units of an oil/gas well drilling rig using reserve pit supernatent fluid, comprising the steps of:

a. floating the inlet of a provided intake conduit at the supernatent liquid layer of the rig reserve pit which pit normally contains an upper supernatent portion and a lower portion containing solids and contaminants;

b. providing a common distribution header;

c. connecting a pump to the intake conduit and header at the intake and discharge portions respectively of the pump;

d. providing one or more branch flow lines affixed to the header, each capable of discharging into the drain of a drilling mud treatment unit, the flow of reserve pit supernatent keeping the drains open;

e. transmitting reserve pit supernatent from the reserve pit to the header by pumping; and f. routing the mud treatment unit drains back into the reserve pit.

2. The method of claim 1 wherein in step "a" the inlet of the intake conduit is provided with a float to maintain the inlet of the intake conduit at the surface of the reserve pit.

3. The method of claim 1 wherein is step "f" the drains flow into the reserve pit by gravity.

4. The method of claim 1 wherein in step "d" the drilling mud treatment unit is a solids control unit.

5. The method of claim 1 wherein in step "d" the drilling mud treatment unit is a shale shaker.

6. The method of claim 1 wherein in step "d" the drilling mud treatment unit is a desilter.

7. The method of claim 1 wherein in step "d" the drilling mud treatment unit is a desander.

8. The method of claim 1 wherein each of the branch lines in step "d" is a flexible hose.

9. The method of claim 1 wherein in step "e" the reserve pit supernatent is continuously circulated from the reserve pit through the intake conduit, by pumping into the header and thence through the various drain lines to the drilling mud treatment unit drains and thence back to the reserve pit.

* * * * *